US010543397B2

(12) United States Patent
Braun

(10) Patent No.: US 10,543,397 B2
(45) Date of Patent: Jan. 28, 2020

(54) EXERCISE DEVICE

(71) Applicant: Lyron Advancement Technologies, Inc., Silver Spring, MD (US)

(72) Inventor: Jason Braun, Silver Spring, MD (US)

(73) Assignee: Lyron Advancement Technologies, Inc., Silver Spring, MD (US)

( * ) Notice: Subject to any disclaimer, the term of this patent is extended or adjusted under 35 U.S.C. 154(b) by 185 days.

(21) Appl. No.: 15/659,164

(22) Filed: Jul. 25, 2017

(65) Prior Publication Data

US 2018/0028860 A1 Feb. 1, 2018

Related U.S. Application Data

(60) Provisional application No. 62/368,447, filed on Jul. 29, 2016.

(51) Int. Cl.

| | |
|---|---|
| ***A63B 23/02*** | (2006.01) |
| ***A63B 21/012*** | (2006.01) |
| ***A63B 21/055*** | (2006.01) |
| ***A63B 21/00*** | (2006.01) |
| ***A63B 23/00*** | (2006.01) |

(52) U.S. Cl.

CPC ..... *A63B 23/0205* (2013.01); *A63B 21/012* (2013.01); *A63B 21/0557* (2013.01); *A63B 21/4005* (2015.10); *A63B 21/4007* (2015.10); *A63B 21/4009* (2015.10); *A63B 21/4025* (2015.10); *A63B 21/4035* (2015.10); *A63B 2023/003* (2013.01)

(58) Field of Classification Search

CPC ..... A63B 23/0205; A63B 23/0211; A63B 21/0125; A63B 21/4025; A63B 21/4007; A63B 21/4005; A63B 21/4009; A63B 21/4035; A63B 21/012; A63B 21/0557; A63B 2023/003; A63B 23/00; A63B 23/02; A63B 23/0216; A63B 23/0222; A63B 23/0227; A63B 23/0233; A63B 23/0238; A63B 2023/006; A63B 23/025; A63B 23/035; A63B 2208/0261

See application file for complete search history.

(56) References Cited

U.S. PATENT DOCUMENTS

| | | | | | |
|---|---|---|---|---|---|
| 3,820,794 | A * | 6/1974 | Inoue | A63B 69/3608 | 473/215 |
| 4,402,505 | A * | 9/1983 | Young | A63B 21/169 | 482/112 |
| 4,456,245 | A * | 6/1984 | Baldwin | A63B 21/155 | 482/100 |
| 4,603,854 | A * | 8/1986 | Krausz | A63B 21/0004 | 482/111 |
| 4,770,414 | A * | 9/1988 | Fredrickson | A63B 23/0211 | 482/148 |
| 5,190,512 | A * | 3/1993 | Curran | A63B 21/0004 | 482/122 |

(Continued)

*Primary Examiner* — Andrew S Lo
(74) *Attorney, Agent, or Firm* — DLA Piper LLP (US)

(57) ABSTRACT

Disclosed herein is a resistance exercise device and methods of using the same. In one embodiment, a resistance exercise device is disclosed comprising a quarter-wheel, a means for attaching resistance to said quarter-wheel, a support means attached to the axis of the quarter-wheel, whereby a user can perform core exercise while moving in a direction parallel to the line of resistance.

17 Claims, 10 Drawing Sheets

(56) References Cited

U.S. PATENT DOCUMENTS 5,248,287 A * 9/1993 Nicoletti ..... A63B 21/0618 482/106
5,269,528 A * 12/1993 McCardle, Jr. ..... A63B 15/00 434/252
5,312,314 A * 5/1994 Stephan ..... A63B 21/0602 482/106
5,769,764 A * 6/1998 Tilberis ..... A63B 23/03575 482/124
5,803,881 A * 9/1998 Miller ..... A63B 21/0004 482/124
6,113,522 A * 9/2000 Fontenot ..... A63B 21/012 482/111
6,213,924 B1 * 4/2001 Kaiyoorawongs ..... A63B 22/14 482/146
6,319,180 B1 * 11/2001 Kallassy ..... A63B 23/0211 482/139
6,386,988 B1 * 5/2002 Shearer ..... A63B 21/06 473/220
7,090,627 B1 * 8/2006 Walker ..... A63B 21/055 482/121
7,625,321 B2 * 12/2009 Simonson ..... A63B 21/152 482/103
8,142,337 B2 * 3/2012 Hall ..... A63B 21/0552 482/129
2001/0029223 A1 * 10/2001 Kallassy ..... A63B 23/0211 482/140
2009/0239675 A1 * 9/2009 Wallace ..... A63B 21/0552 473/220
2012/0264578 A1 * 10/2012 Frederick ..... A63B 21/0004 482/132
2014/0057763 A1 * 2/2014 Fritsch ..... A63B 21/06 482/109
2014/0309081 A1 * 10/2014 Gavigan ..... A63B 15/00 482/8
2016/0096057 A1 * 4/2016 Gavigan ..... A63B 65/04 482/109
2016/0144220 A1 * 5/2016 Wood ..... A63B 21/00185 482/93

* cited by examiner

EXERCISE DEVICE

CROSS REFERENCE TO OTHER RELATED APPLICATIONS

This application claims priority to U.S. Provisional Application Ser. No. 62/368,447 filed on Jul. 29, 2016, which is hereby incorporated in its entirety.

TECHNICAL FIELD

The present invention relates to exercise devices, e.g., resistance exercise devices, and particularly to devices for strengthening core muscles.

BACKGROUND

Performing an effective trunk twist requires targeting the core muscles. When performing trunk exercises an exerciser must use a machine or device to stabilize the upper body to avoid using the muscles of the scapula and glenohumeral joint. By avoiding the use of these shoulder muscles an exerciser maximizes the use of the core muscles of the trunk, thus strengthening those core muscles in the most effective manner. Until now, the only exercise machines that could maximize the use of core muscles were extremely bulky and expensive. For those reasons, the previous art was typically suitable for only large commercial gyms.

Traditionally, trunk twist exercises have been performed either (1) on a seated torso rotation machine, which stabilizes both the upper and lower body, such as the technology disclosed by U.S. Pat. No. 4,456,245 ("the '245 patent"), or (2) standing, with arms extended holding a cable or a resistance band, such as the technology disclosed by U.S. Pat. No. 7,625,321 ("the '321 patent").

The seated torso rotation machine is effective by providing a guided path of motion, parallel to the resistance, and the trunk muscles are driving the majority of the force necessary to complete the exercise. In this exercise, sitting down stabilizes the lower body, the shoulder pads stabilize the shoulder complex, and thus the upper body alone drives the force of motion. Accordingly, the trunk muscles are sufficiently isolated, requiring the trunk muscles to perform a majority of the work. However, the machine is too expensive and too bulky for many commercial gyms, and virtually all home gyms.

Because a seated torso rotation machine is often unavailable, many exercisers perform a trunk twist exercise standing, with arms extended, holding a cable or a resistance band, and twisting in each direction. With the standing exercise, because the exerciser is holding the cable at arm's length in front of the chest, the shoulder complex influences the effectiveness of the exercise. In this exercise, where the load is distal to the body, this lack of stability and restraint in the upper body greatly reduces the amount of force through the trunk. But, because the arms and shoulders are still working to perform the twist, and exerciser often does not realize that the arms and shoulders are helping to perform the exercise, reducing the amount of force through the trunk. In an effort to alleviate this problem, users can perform this exercise holding a large exercise ball in between the arms. The addition of the exercise ball greatly increases the stability through the shoulder complex, making the exercise more efficient, but holding the ball between the arms is virtually impossible because the ball is bulky and uncomfortable to hold.

The Ground Force 360, which is explained at http://rotationalexercise.com/ground-force-360/, is similar to the seated torso rotation machine, as disclosed in the '245 patent, because it effectively loads the trunk muscles and provides a guided path of resistance that is parallel to the path of motion. In this exercise, the user stands at the machine and has shoulder-stabilizing pads on the front and back of each shoulder. Similar to the shoulder pads in the '245 patent, the shoulder pads on the Ground Force 360 stabilize the shoulder complex, allowing the user to drive the maximum amount of force through the trunk muscles. However, the Ground Force 360, similar to the seated torso rotation machine, is too expensive and too bulky for most commercial gyms, and virtually all home gyms.

Trunk twists may also be performed by adding weight to an exerciser's shoulders at the back of the neck using a weighted bar, such as the technology disclosed by U.S. Pat. No. 5,312,314 ("the '314 patent), or similarly with a semi-circular bar as disclosed in U.S. Pat. No. 5,248,287 ("the '287 patent"). These exercises, however, load the trunk muscles inefficiently. Exercise is most effective when loads and the direction of resistance are parallel. The load and resistance in this exercise is perpendicular to the path of motion. Accordingly, this exercise is not an effective way to load the trunk muscles for a twisting exercise.

Another method of adding resistance is by using air resistance with a paddle on the shoulders that would provide air resistance during a twisting motion, such as the technology disclosed in U.S. Pat. No. 4,603,854 ("the '854 patent"). Because of the air paddles, the load and the direction of resistance are parallel. However, the speed of motion, which dictates the amount of force, requires an exerciser to move faster in order to increase resistance. The faster motion leads to a greater risk of injury. Accordingly, using air resistance with a paddle on the shoulders, because it does not allow the user to increase the resistance while maintaining a constant speed, is not the most effective way to perform this exercise.

Despite existing resistance based exercise machines, there still exists problems with the existing machines that stabilize the upper body, removing the scapular/glenohumeral involvement in a trunk twist, because these machines are bulky, not portable, and expensive. There also still exists problems with other machines and methods that are more portable and/or less expensive, because those machines and methods fail to stabilize the upper body, thus allowing scapular/glenohumeral involvement in a trunk twist exercise, and thus greatly reducing the amount of force production through the trunk and core muscles. In most of these methods and exercises, the load is also not the most efficient for the exercise: it is either distal to the body, or it is not parallel to the direction of resistance.

Despite existing resistance based exercise machines, there still exists a need for a resistance based trunk rotation device which is portable, lightweight, less bulky, less expensive, stabilizes the upper body, removing scapular/glenohumeral involvement in the exercise, and thus increasing the efficiency of the exercise and the ability of the exercise to exert force production through the trunk and core muscles, and can be loaded progressively over time as the exerciser gets stronger.

BRIEF DESCRIPTION OF THE DRAWINGS

In the drawings, closely related figures have the same number but different alphabetic suffixes. In the drawings, the following reference numerals are used to show illustrative and conceptual components of the disclosed devices:

| | | | |
|---|---|---|---|
| 10 | support means | 12 | quarter-wheel |
| 14 | groove | 16 | handles |
| 18 | means for attaching resistance | | |

FIGS. 1A through 10 schematically illustrate various aspects of one example of a quarter-wheel for attaching resistance, with a support means attached to the axis of the quarter-wheel in accordance with one embodiment.

Figure 2A:
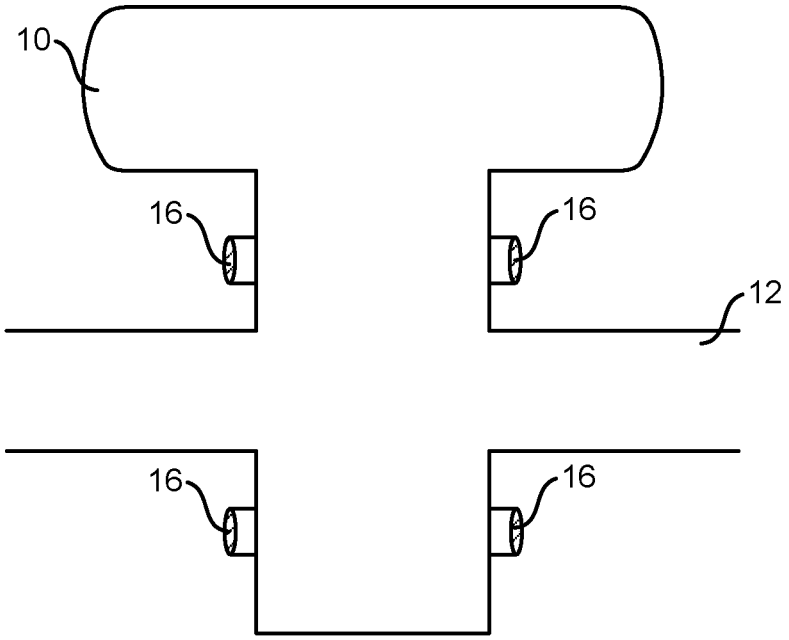
Figure 2B:
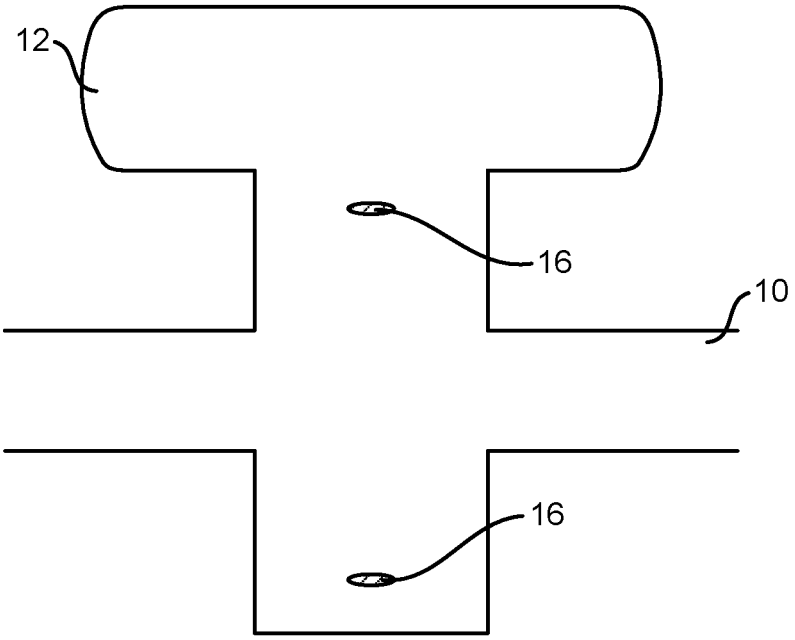
Figure 2C:
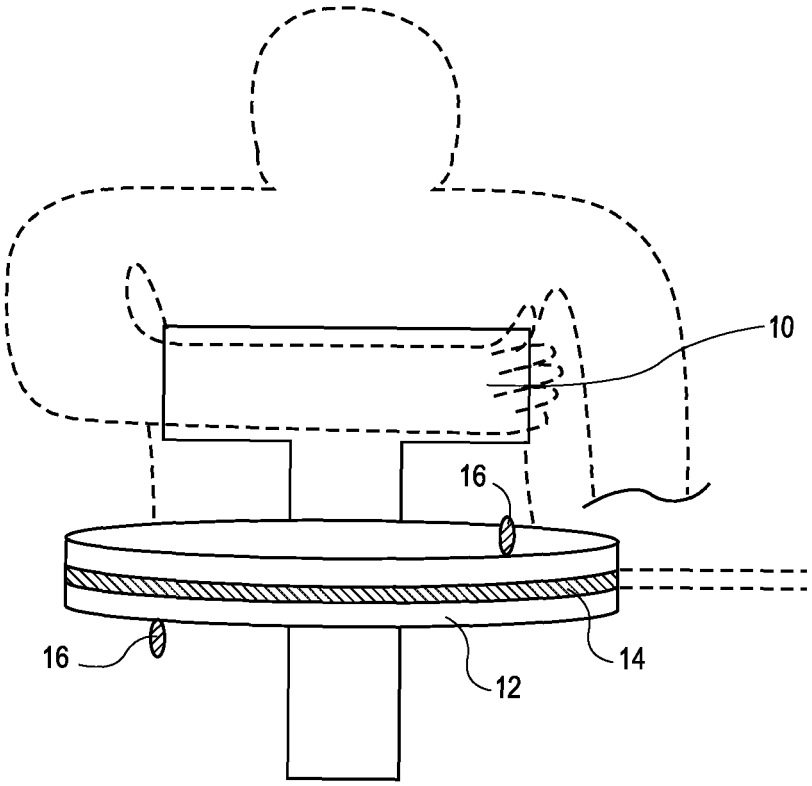

FIGS. 2A, 2B, and 2C schematically illustrate examples of the support means with various combinations of handles in accordance with some embodiments.

Figure 3A:
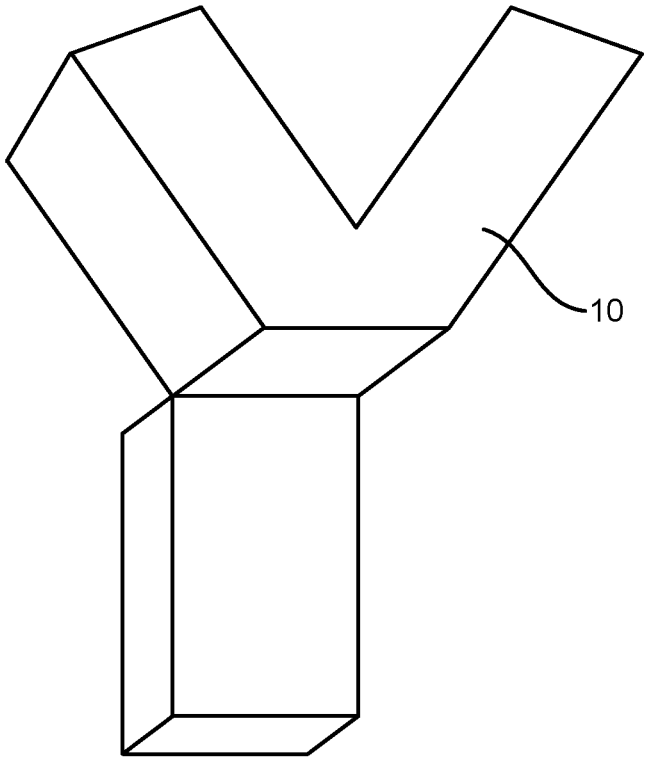
Figure 3B:
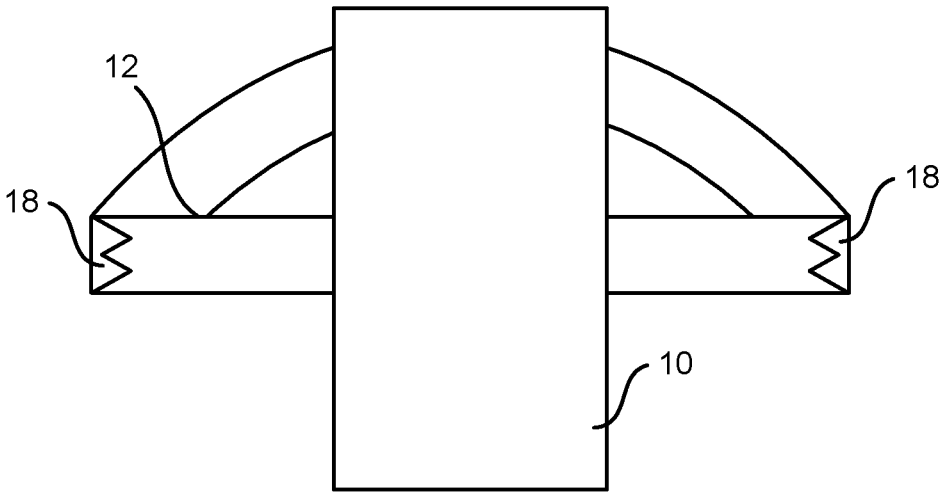
Figure 4A:
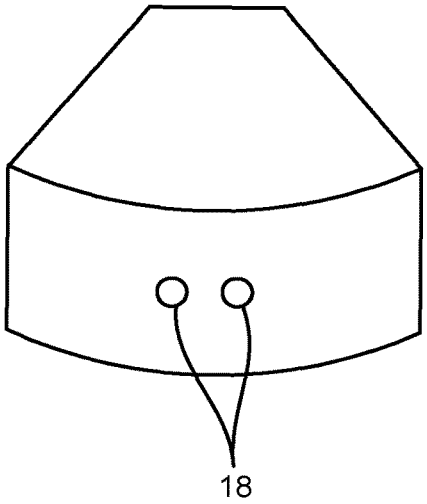
Figure 4B:
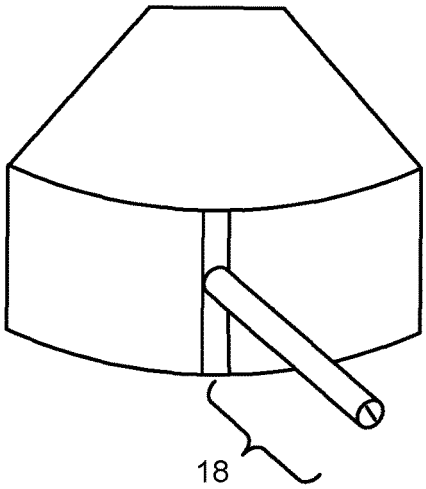
Figure 4C:
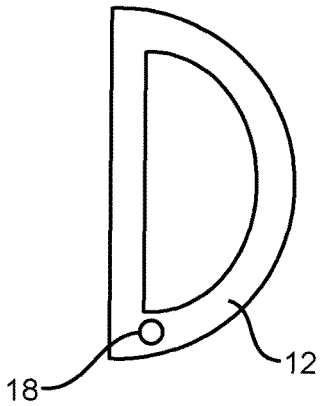

FIGS. 3A and 3B schematically illustrate examples of the various shapes of the support means in accordance with some embodiments FIGS. 4A, 4B, and 4C schematically illustrate examples of the various combinations of methods to attach resistance in accordance with some embodiments.

Figure 5A:
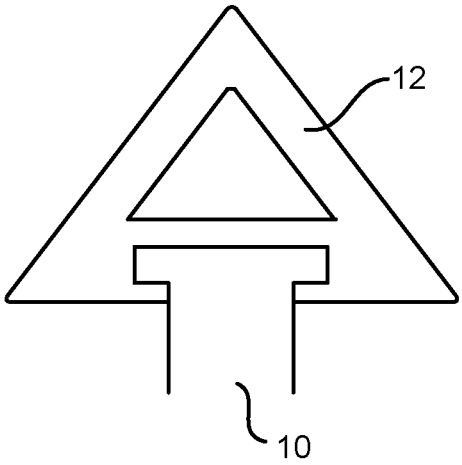
Figure 5B:
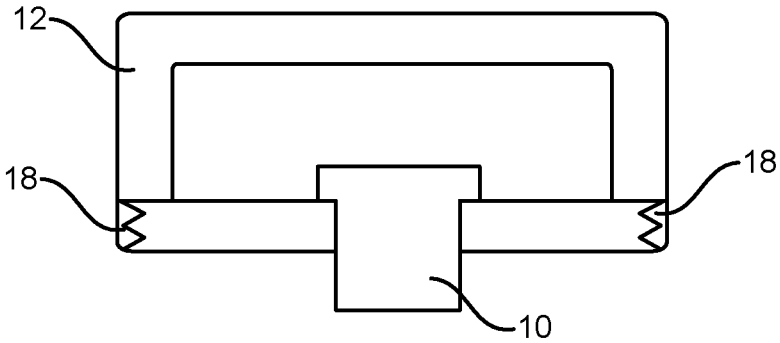

FIGS. 5A and 5B schematically illustrate examples of the various combinations of shapes of the quarter-wheel wherein the quarter-wheel comprises a triangular or rectangular piece of material in accordance with some embodiments.

Figure 5C:
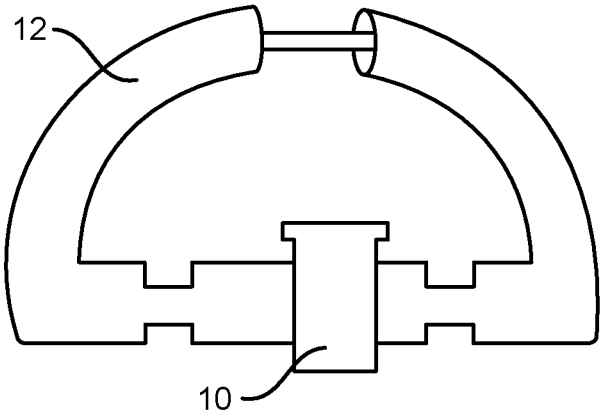

FIG. 5C schematically illustrates one example of the various combinations of shapes of the quarter-wheel when the quarter-wheel is adjustable.

Figure 6:
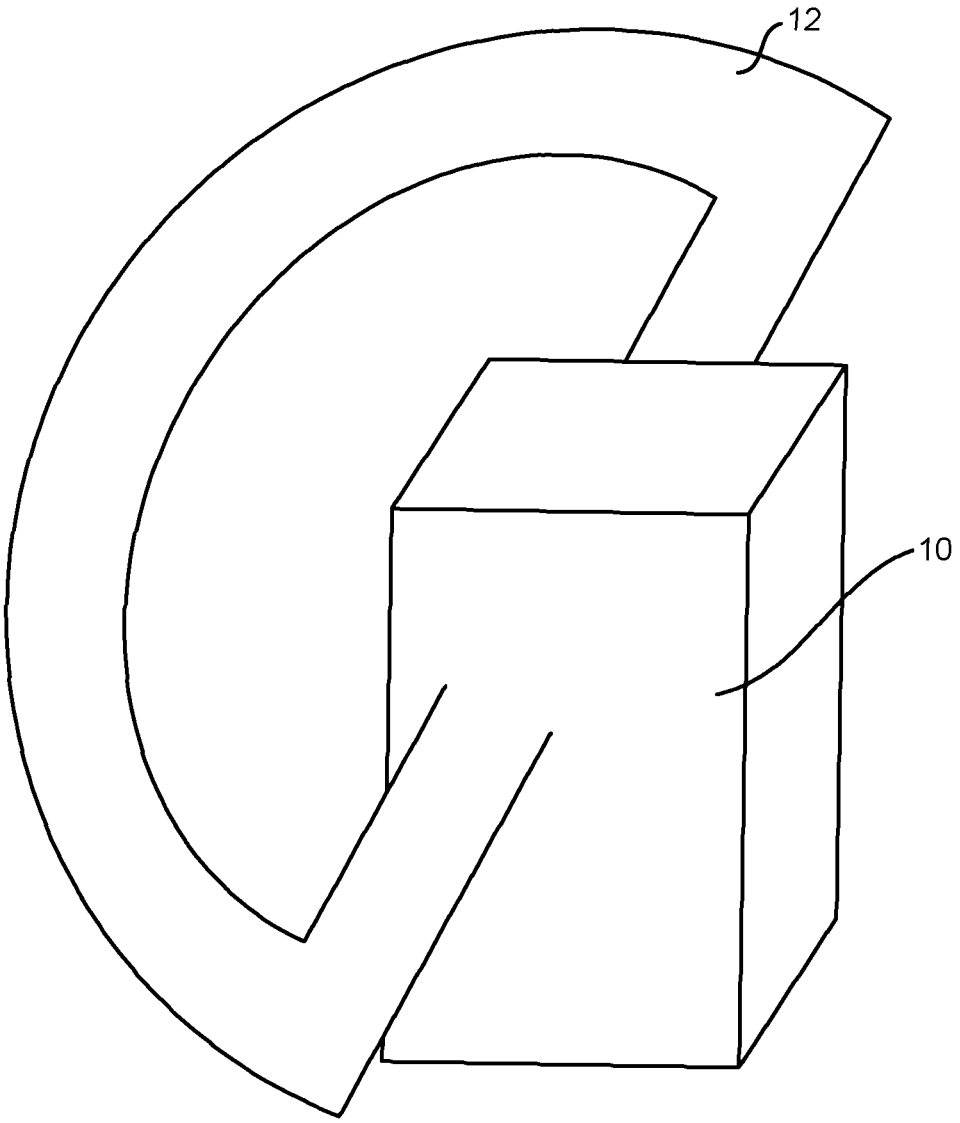

FIG. 6 schematically illustrates one example of the combination of shapes of the support means in accordance with some embodiments for the use of the exercise device with the legs.

Figure 7:
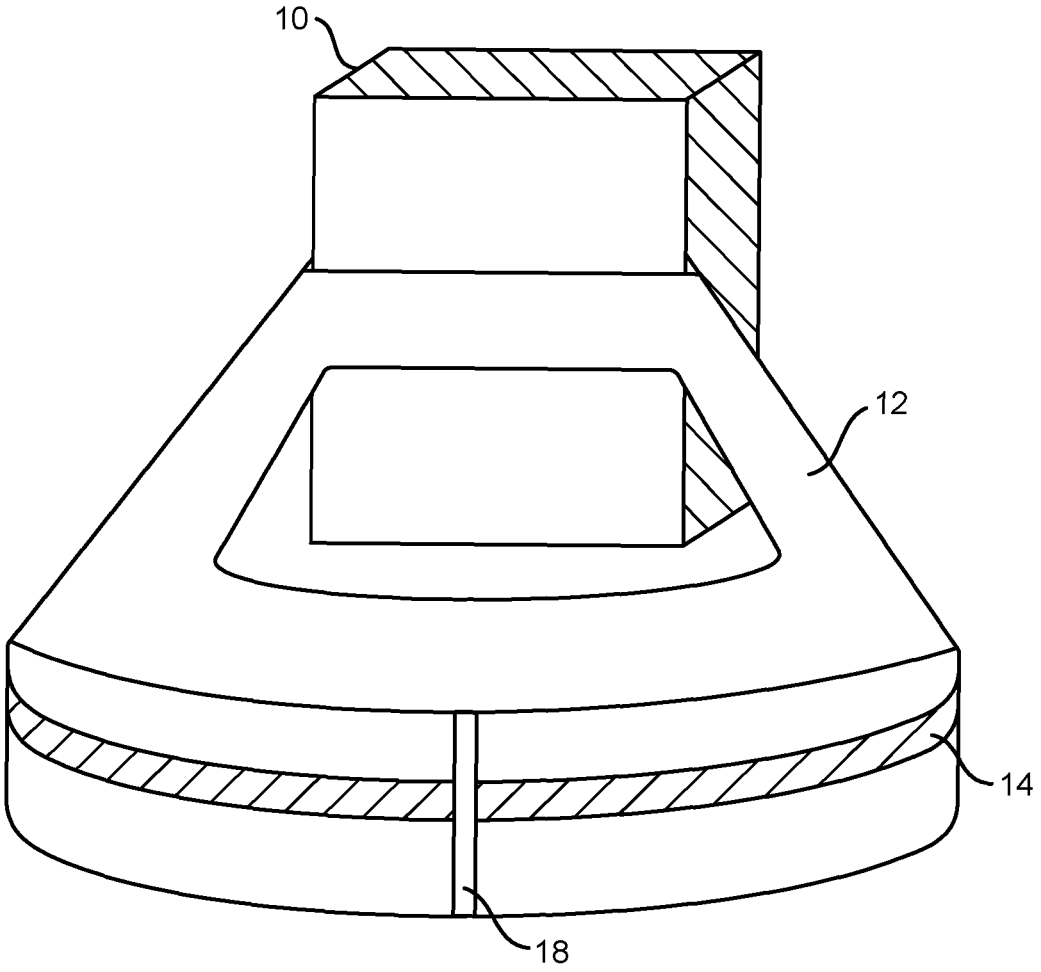

FIG. 7 schematically illustrates one example of the combination of shapes of the support means in accordance with some embodiments for the use of the exercise device with abdominal crunches or back extensions.

Figure 8:
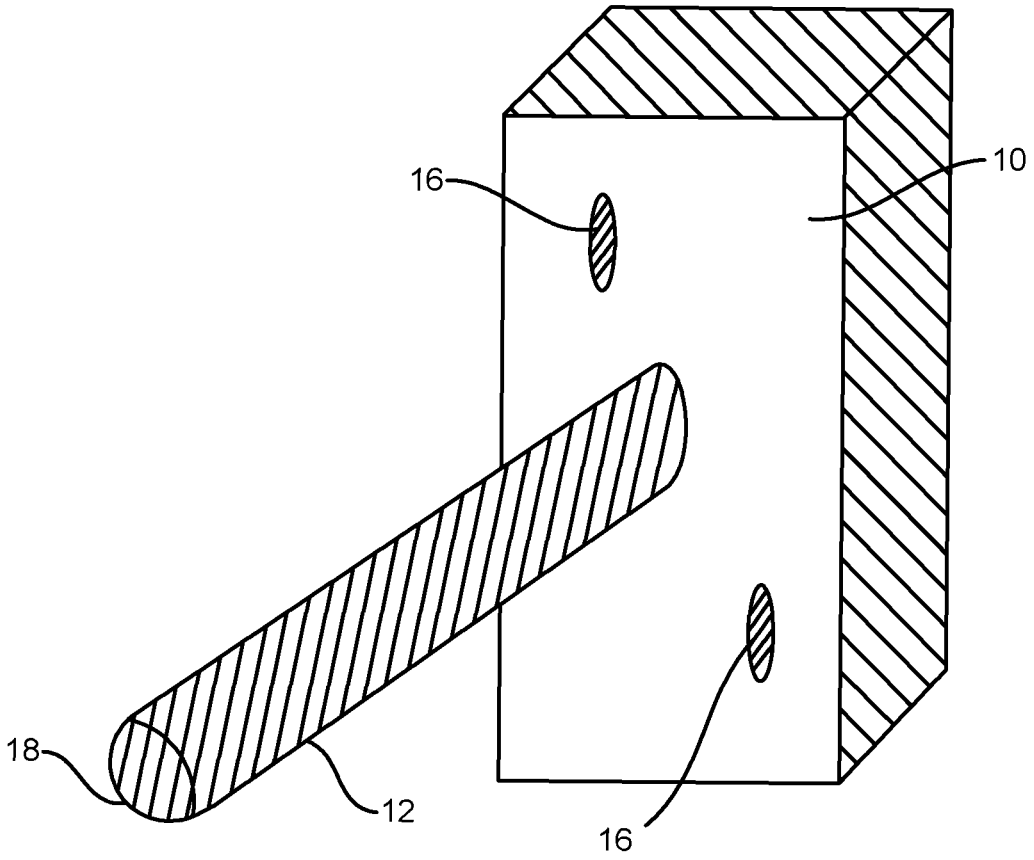

FIG. 8 schematically illustrates one example of the combination of shapes of the quarter-wheel wherein the quarter-wheel comprises a bar or rod in accordance with some embodiments.

Figure 1A:
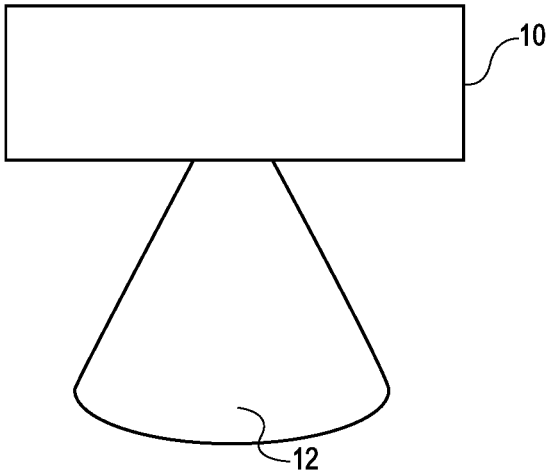
Figure 1B:
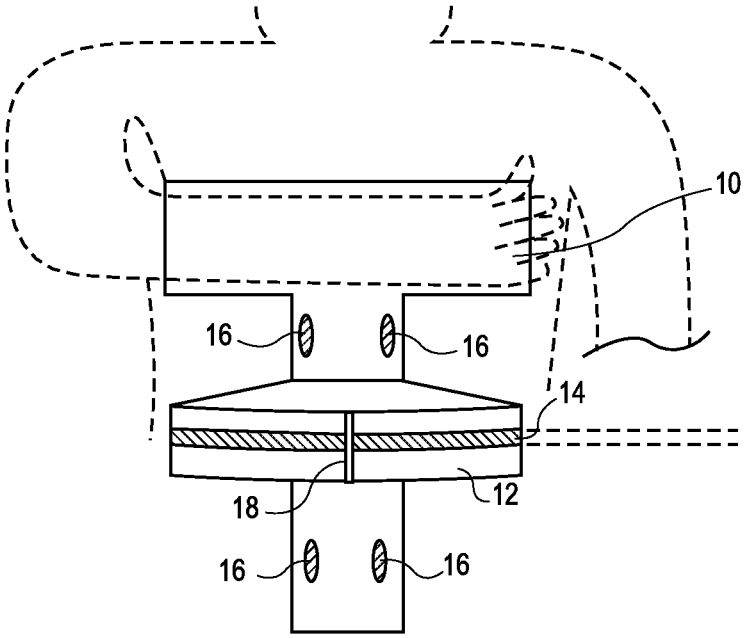
Figure 1C:
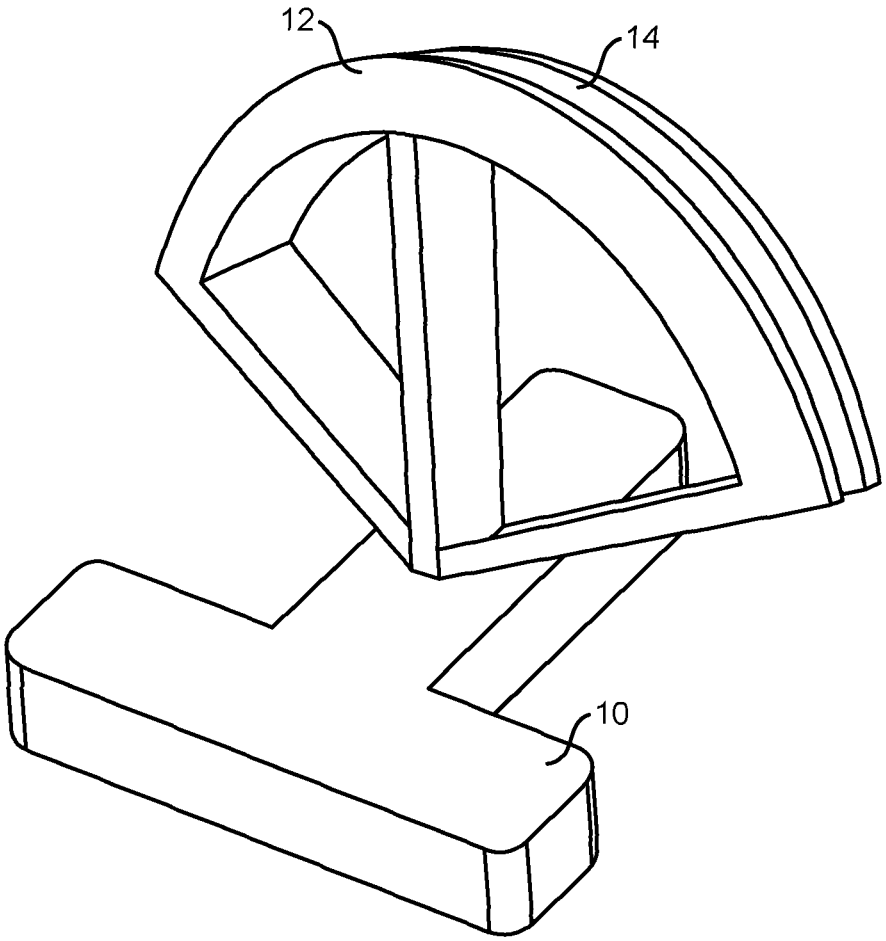

One embodiment of the exercise device is illustrated in FIG. 1A (top view), FIG. 1B (front view), and FIG. 10 (side view).

At each end of the quarter-wheel is a means for attaching resistance, 18. One example of the means for attaching resistance is a bar inlaid in a hole in the quarter-wheel (FIG. 1B). Other examples of means for attaching resistance include a ring, a hook, a spring clip, a hole inlaid in the quarter-wheel, a claw similar in shape and rigidity to a nail puller, to hold the resistance in place (FIG. 3B), or a combination of any of the various means for attaching resistance. The means for attaching resistance can be placed in a variety of locations on the disclosed devices, including on only one side of the quarter-wheel, at a corner of the quarter-wheel and parallel to the support means, or at any point on the outside or inside of the quarter-wheel. In one embodiment, the means for attaching resistance is the same plastic as the quarter-wheel. In one embodiment, the means for attaching resistance are another type of plastic, aluminum, carbon, a metal alloy, wood, Velcro, or a magnet.

In one embodiment, the support means 10 is between 8 to 15 cm thick. In one embodiment, the support means 10 is of varying thickness according to personal comfort. In one embodiment, the support means 10 has overall dimensions of roughly 15 to 40 cm tall and 15 to 30 cm wide. In one embodiment, the corners of the support means are beveled to avoid snagging and personal injury. In one embodiment, the corners of the support means are rounded to avoid snagging and personal injury.

In one embodiment, the quarter-wheel 12 is ovular. In one embodiment, the quarter-wheel 12 is 35 to 60 cm in width, measured along the base of the quarter-wheel. In one embodiment, the quarter-wheel 12 is with a 30 to 40 cm width, measured from the apex of the quarter-wheel to the axis of rotation.

DETAILED DESCRIPTION

Disclosed herein is a new exercise device. In one embodiment, the exercise device stabilizes the upper body, removing the scapular involvement in a trunk twist, allowing for more efficient and greater force production through the trunk. In one embodiment, the exercise device stabilizes the upper body, removing the glenohumeral involvement in a trunk twist, allowing for more efficient and greater force production through the trunk. In one embodiment, the exercise device stabilizes the upper body, removing the scapular and glenohumeral involvement in a trunk twist, allowing for more efficient and greater force production through the trunk. Some embodiments provide an exercise device that it less expensive, or more attractive, or less bulky, or more portable, than existing exercise devices.

Disclosed herein is a new resistance based trunk rotation device. In one embodiment, the device is portable. In one embodiment, the device is lightweight. In one embodiment, the device is small. In one embodiment, the device is affordable. In one embodiment, the device is loaded progressively. In one embodiment, the device stabilizes the upper body. In one embodiment, the device prevents scapular/glenohumeral involvement in an exercise, thus increasing the efficiency of the exercise and the ability of the exerciser to exert force production through the trunk and core muscles.

Disclosed herein is a resistance exercise device, comprising:

a half-wheel;

a support means, connected to the half-wheel;

the support means positioned at an axis of rotation of the half-wheel;

a means for attaching resistance to the half-wheel.

Disclosed herein is a resistance exercise device, comprising:

a quarter-wheel;

a support means, connected to the quarter-wheel;

the support means positioned at an axis of rotation of the quarter-wheel;

a means for attaching resistance to the quarter-wheel.

As used herein, the term "half-wheel" means a solid structure having an outside edge positioned at some distance from a central axis of rotation. In one embodiment, the term half-wheel refers to a bisected circle. However, within the context of this disclosure, the term "half-wheel" is not limited to wheels, circular, or even ovular shapes. Rather, the term "half-wheel" includes any shape (e.g., triangle, rectangle, circle, oval, polygon, etc.). In one embodiment, the half-wheel is a quarter-wheel.

As used herein, the term "quarter-wheel" means a solid structure having an outside edge positioned at some distance from a central axis of rotation. In one embodiment, the term "quarter-wheel" means a quadrisected circle.

Within the context of this disclosure, the term "quarter-wheel" is not limited to wheels, circular, or even ovular shapes. Rather, the term "quarter-wheel" includes any shape (e.g., triangle, rectangle, circle, oval, polygon, bisected wheel, etc.). For example, the quarter-wheel is a quadrisected circle. See FIGS. 5A, B, and C for examples of quarter-wheel shapes.

Within the context of this disclosure, any angle may be used with regard to a "quarter-wheel", "half-wheel", or any shape. For example, while the term "quarter-wheel" may refer to a shape with a 90 degree angle a quarter-wheel with an angle between 0 to 360 is disclosed.

As used herein, the term "axis of rotation" refers to a point on the outer edge of the quarter-wheel located at a distance from the means for attaching resistance to the quarter-wheel. In one embodiment, when the quarter-wheel is a quadrisected wheel, the "axis of rotation" is the center of the wheel if the wheel were not quadrisected. In one embodiment, the axis of rotation is a point on the outer edge of the quarter-wheel.

In one embodiment, the quarter-wheel contains one or more spokes.

In one embodiment, the quarter-wheel contains no spokes.

As used herein, the term "spoke" means a connection between an axis of rotation to an outer edge of the quarter-wheel. In one embodiment, the spoke is a rod. In one embodiment, the spoke is a wire. In one embodiment, the spoke is metal. In embodiment, the spoke is plastic.

In one embodiment, quarter-wheel comprises a means for maintaining contact between the resistance cable and the quarter-wheel at the edge of the quarter-wheel. See, e.g., FIG. 10 at nos. 12 and 14.

As used herein, the term "means for maintaining contact between the resistance cable and the quarter-wheel" refers to an element allowing, by natural force or otherwise, the form of resistance to connect to the quarter-wheel throughout a twisting exercise, e.g., performed by a user twisting at the axis of rotation. In one embodiment, the means for maintaining resistance between the resistance cable and the quarter-wheel is a groove.

Within the context of this disclosure, the term "means for maintaining contact between the resistance cable and the quarter-wheel" is not limited to a groove or any other method for maintaining the connection. Rather, the term "means for maintaining contact between the resistance cable and the quarter-wheel" includes any method for connecting an element A to element B, e.g., one or more snaps, one or more spring clips, or one or more pins.

As used herein, the term "groove" means a concave path created for containing the resistance cable. In one embodiment, the term groove means a prolonged indent, i.e., a channel.

Within the context of this disclosure, the term "groove" is not limited to indented paths. Rather, the term "groove" includes any form of guided path, e.g., the use of raised pins or holes for threading the resistance cable.

As used herein, the term "resistance" refers to a force or forces acting in opposition to another force or forces. Resistance offers the ability to develop muscle strength by developing strength to overcome an opposing force or forces. In one embodiment, resistance is tension force, e.g., rope, cable, or string. In one embodiment, resistance is gravity, e.g., a stack of weights used w a pulley system(s) and cables. In one embodiment, resistance is normal force, e.g., an object pushing against the device. In one embodiment, resistance is friction. In one embodiment, resistance is implemented through a resistance cable.

As used herein, the term "resistance cable" means a cord through which force is transferred. A resistance cable provides tension providing an exerciser with an opportunity to develop strength to overcome this tension. Within the context of this disclosure, the term "resistance cable" is not limited to cords, cables, string, thread, strand, rope, etc. Rather, the term "resistance cable" includes any means for supplying resistance to the devices disclosed herein, e.g., exercise bands, rubber bands, exercise bars, metal bars, etc.

In one embodiment, the quarter-wheel is made out of a rigid material.

As used herein, the term "rigid material" refers to a substance maintaining its shape or form. For example, a material that is not easily bendable, flexible, or malleable. In one embodiment, the rigid material is a hard plastic. In one embodiment, the rigid material is metal. In one embodiment, the rigid material is aluminum. In one embodiment, the rigid material is a hard foam. In one embodiment, the rigid material is rubber.

In one embodiment, the quarter-wheel is made out of a light material.

As used herein, the term "light material" refers to a substance with a low density, e.g., a number expressed in $kg/m^3$. In one embodiment, the light material is plastic. In one embodiment, the light material is foam. In one embodiment, the light material is cloth.

In one embodiment, the quarter-wheel is made out of a light, rigid material.

In one embodiment, the quarter-wheel is configured in an ovular shape.

In one embodiment, the quarter-wheel is configured in a circular shape.

In one embodiment, the quarter-wheel is configured in a rectangular shape. (See, e.g., FIG. 5B).

In one embodiment, the quarter-wheel is configured in a triangular shape. (See, e.g., FIG. 5A).

In one embodiment, the quarter-wheel is configured in a polygonal shaped.

In one embodiment, the quarter-wheel is configured in a bar or rod shape.

In one embodiment, the quarter-wheel is configured in a bar or rod shape with a depth and length of about 1 to 30 cm (See, e.g., FIG. 8).

In one embodiment, the quarter-wheel is made of plastic. In one embodiment, the quarter-wheel is made of aluminum. In one embodiment, the quarter-wheel is made of carbon. In one embodiment, the quarter-wheel is made of metal. In one embodiment, the quarter-wheel is made of wood. In one embodiment, the quarter-wheel is made of magnetized metal. In one embodiment, the quarter-wheel is made of a combination of materials, including but not limited to those above.

In one embodiment, the quarter-wheel comprises a rigid piece of material with a width of about 45 to 65 cm, measured from the axis of rotation to the outer edge of the quarter-wheel.

In one embodiment, the quarter-wheel comprises a rigid piece of material with a width of about 30 to 75 cm, measured from the axis of rotation to the outer edge of the quarter-wheel.

In one embodiment, the quarter-wheel comprises a rigid piece of material with a width of about 15 to 85 cm, measured from the axis of rotation to the outer edge of the quarter-wheel.

In one embodiment, the quarter-wheel is hollow.

In one embodiment, the quarter-wheel comprises a fixed shape.

In one embodiment, the quarter-wheel is adjustable, for example to accommodate different body sizes and different amounts of resistance. See, e.g., FIG. 5C.

In one embodiment, the quarter-wheel comprises a groove along the outer edge. In one embodiment, the groove guides a resistance band or cable.

In one embodiment, the quarter-wheel comprises a second means for maintaining connection between the resistance cable and exercise device.

In one embodiment, the quarter-wheel does not have a means for maintaining connection between a resistance cable and an exercise device.

In one embodiment, the method for maintaining connection between the resistance cable and exercise device is a groove.

In one embodiment, the method for maintaining connection between the resistance cable and exercise device comprises one or more snaps placed along the edge of the quarter-wheel.

As used herein, term "snap" refers to a mechanism for attaching one thing to another with interlocking components such as a snapping button. In one embodiment, the snap comprises a circular lip under one disc fitting into a groove on the top of the other.

In one embodiment, the method for maintaining connection between the resistance cable and exercise device comprises one or more spring clips placed along the edge of the quarter-wheel.

As used herein, the term "spring clip", "crocodile clip", or "alligator clip" refers to a device clasping, hooking, gripping, or holding two or more things together. In one embodiment, the spring clip is composed of metal. In one embodiment, the spring clip comprises serrated teeth for grasping onto the things held together.

In one embodiment, the method for maintaining connection between the resistance cable and exercise device comprises studs or pins forming a path through which the resistance cable passes.

As used herein, the term "stud" or "pin" refers to a protrusion. In one embodiment, the pin is a bar of metal with a plastic handle. In one embodiment, the stud is a raised indentation along the quarter-wheel.

In one embodiment, the method for maintaining connection between the resistance cable and exercise device comprises threading the cable through the quarter-wheel.

As used herein, the term "support means" refers to an element bracing the quarter-wheel against the exerciser. In one embodiment, the support means is a T-shaped block. Within the context of this disclosure, the term "support means" is not limited to a T shape. Rather, the term "support means" includes any shape. In one embodiment, the support means is in a rectangular shape. In one embodiment, the support means is in a triangular shape. In one embodiment, the support means is in a polygonal shape. In one embodiment, the support means is in a circular shape. In one embodiment, the support means is in an ovoid shape. In one embodiment, the support means is in a Y-shape. In one embodiment, the support means is in a convex shape.

In one embodiment, the support means has no attachment to the exerciser. In one embodiment, the support means comprises arm straps. In one embodiment, the support means comprises shoulder straps. In one embodiment, the support means comprises a waist belt. In one embodiment, the support means comprises chest straps. In one embodiment, the support means comprises sleeves. In one embodiment, the support means comprises a vest.

In one embodiment, the exerciser hugs the support means to his or her chest and twists parallel to the direction of the resistance in a direction away from the resistance.

In one embodiment, the exerciser secures the support means to his or her chest by strapping the support means to his or her torso. In one embodiment, the devices disclosed herein comprise straps. In one embodiment, the straps secure the support means to an exerciser's shoulders. Within the context of this disclosure, the term "straps" are not limited to shoulder straps. Rather, the term "straps" includes any means for securing the device to an exerciser's body, e.g., the exerciser's chest, waist, etc. In one embodiment, the straps are made from cloth. In one embodiment, the straps are made from leather. In one embodiment, the straps are made from plastic.

In one embodiment, the exerciser secures the support means to his or her chest by wearing a vest.

In one embodiment, the exerciser secures the support means to his or her chest with sleeves secured around any part of the arm. In one embodiment, the sleeves are located above the support means. In one embodiment, the sleeves are located below the support means. In one embodiment, the sleeves are located on the sides of the support means.

In one embodiment, the support means is contoured.

As used herein, the term "contoured" refers to shaped, molded, or designed to fit another shape, e.g., body, device, etc.

Accordingly, in one embodiment the exercise device disclosed herein comprises a contoured support means, which is made out of a rigid material.

In one embodiment, the support means is provided in a "T" shape.

In one embodiment, the support means is provided in a contoured "T" shape.

In one embodiment, the support means is provided as a convex "T" shape.

In one embodiment, the support means is provided in a "Y" shape.

In one embodiment, the support means is provided in a contoured "Y" shape.

In one embodiment, the support means is provided as a convex "Y" shape.

In one embodiment, the support means is provided in a "V" shape.

In one embodiment, the support means is provided in a contoured "V" shape.

In one embodiment, the support means is provided as a convex "V" shape.

In one embodiment, the support means is provided in a rectangular shape. See, e.g., FIG. 3B.

In one embodiment, the support means is provided in a triangular shape.

In one embodiment, the support means is provided in two pieces on either side of the quarter-wheel.

In one embodiment, the support means is provided in two pieces on either side of the quarter-wheel, wherein the top piece is a contoured V shape and the bottom piece is a rectangular shape. See, e.g., FIG. 3A.

In one embodiment, the support means is provided in two pieces on either side of the quarter-wheel, wherein said two pieces rest against the user's chest and trunk.

In one embodiment, the support means is provided in two pieces on either side of the quarter-wheel, wherein one piece rests against the user's chest, and user braces the bottom piece with his hand.

In one embodiment, the support means is provided in two pieces on either side of the quarter-wheel, wherein the top piece is a contoured V shape that rests against the user's chest and the bottom piece is a rectangular shape that hangs freely from the quarter-wheel and the user braces his or her hand against the side of the rectangular shape.

In one embodiment, the support means is made of a rigid material. In one embodiment, the rigid material is plastic. In one embodiment, the rigid material is cork. In one embodiment, the rigid material is rubber. In one embodiment, the rigid material is carbon. In one embodiment, the rigid material is aluminum. In one embodiment, the rigid material is metal. In one embodiment, the rigid material is wood. In one embodiment, the rigid material is a combination from the aforementioned materials.

In one embodiment, the support means comprises rigid plastic.

In some embodiments, the support means is made of a soft material.

As used herein, the term "soft material" refers to a substance that is flexible, bendable, or malleable. In one embodiment, the soft material is chosen from rubber, foam, high-density foam, neoprene, cloth, or a combination thereof.

In one embodiment, the support means comprises foam.

In one embodiment, the support means is made of a combination of rigid and soft materials.

In one embodiment, the support means is made of rigid plastic and high-density foam padding, allowing a user to comfortably hug the said support means against to the user's body.

In one embodiment, the support means is covered with padding to make it more comfortable to the user.

In one embodiment, the support means is hollow.

In one embodiment, the support means comprises rubber filled with air.

In one embodiment, the support means contains one or more handles along the sides.

As used herein, the term "handle" refers to an element by which the user can hold the machine with his hand. In one embodiment, the term handle refers to an external protrusion, e.g., rod, knob, etc.

Within the context of this disclosure, the term "handle" is not limited to an external handle protruding from the machine. Rather, the term "handle" includes any method, element, implementation, etc., of providing a place for a user's hands to rest and/or brace the machine, e.g., padding, grooves, contours, etc.

In one embodiment, the handles are grooved. In one embodiment, the handles are contoured. In one embodiment, the handles are grooved and carved into the support means. In one embodiment, the handles are padded. In one embodiment, the handles are padded areas on the support means. In one embodiment, the handles are padded areas positioned on the support means below the axis of rotation. In one embodiment, the handles are padded areas positioned on the support means above the axis of rotation. In one embodiment, the handles are padded areas positioned on the support means above and below the axis of rotation.

In one embodiment, the first handle is a groove positioned on the support means above the axis of rotation of the quarter-wheel and the second handle is a groove positioned on the support means below the axis of rotation of the quarter-wheel. See FIG. 2B for one illustrative example.

In one embodiment, the handle is external. In one embodiment, the handle protrudes outward from the support means. In one embodiment, one or more handles are attached to the quarter-wheel. In one embodiment, the device comprises a first handle and a second handle. In one embodiment, the device comprises a first handle, a second handle, and a third handle. In one embodiment, the device comprises a first handle, a second handle, a third handle, and a fourth handle.

In one embodiment, the handle is attached to the top of the support means. In one embodiment, the handle is attached to the side of the support means.

In one embodiment, the first handle is external and positioned on the support means above the axis of rotation of the quarter-wheel and the second handle is external and positioned on the support means above the axis of rotation of the quarter-wheel.

In one embodiment, the third handle is external and positioned on the support means below the axis of rotation of the quarter-wheel and the fourth handle is external and positioned on the support means below the axis of rotation of the quarter-wheel. See, e.g., FIG. 2A as one illustrative example.

In one embodiment, the handle is composed of plastic. In one embodiment, the handle is composed of aluminum. In one embodiment, the handle is composed of carbon. In one embodiment, the handle is composed of a metal alloy. In one embodiment, the handle is composed of wood. In one embodiment, the handle is composed of a combination of the aforementioned materials.

As used herein, the term "means for attaching resistance" refers to an element holding an anchor point, or input of resistance, of a resistance cable to the quarter-wheel. In one embodiment, the means for attaching resistance is a claw grabbing a knob at the end of a particular resistance cable that is attached to a cable resistance exercise machine.

Within the context of this disclosure, the term "means for attaching resistance" is not limited to claws, hooks, or clasps. Rather, the term "means for attaching resistance" includes any method for applying any resistance to the quarter-wheel, whether impermanent, semi-permanent, or permanent, e.g., magnets, velcro, glue, cable, etc.

In one embodiment, the means for attaching resistance is a hole inlaid in the quarter-wheel with a bar bisecting the hole. See, e.g., FIG. 1B at 18.

In one embodiment, the means for attaching resistance comprises a post inlaid in the quarter-wheel, attached to a cable and a spring clip. See, e.g., FIG. 4B.

In one embodiment, the means for attaching resistance comprises a claw.

In one embodiment, the means for attaching resistance comprises a claw similar in shape and rigidity to a nail puller.

In one embodiment, the means for attaching resistance comprises a claw grabbing the knob at one end of a particular resistance cable that is attached to a cable resistance exercise machine.

In one embodiment, the means for attaching resistance comprises a ring. See, e.g., FIG. 4C. In one embodiment, the ring is circular. In one embodiment, the ring is oblong.

In one embodiment, the means for attaching resistance comprises a carabiner.

In one embodiment, the means for attaching resistance is a hole inlaid in the quarter-wheel. See, e.g., FIG. 4A.

In one embodiment, the means for attaching resistance comprises a spring clip.

In one embodiment, the means for attaching resistance comprises a hook.

In one embodiment, the means for attaching resistance comprises a clasp.

In one embodiment, the means for attaching resistance comprises velcro.

In one embodiment, the means for attaching resistance comprises one or more magnets.

In one embodiment, the means for attaching resistance comprises glue.

In one embodiment, the means for attaching resistance comprise plastic, aluminum, carbon, alloy, and/or wood.

In one embodiment, the means for attaching resistance includes at least one attachment point positioned on the quarter-wheel.

As used herein, the term "attachment point" refers to a position on the quarter-wheel where another thing may be connected. In one embodiment, the attachment point is a hole located on the outer edge of the quarter-wheel. In one embodiment, the attachment point is a clip located on the outer edge of the quarter-wheel. In one embodiment, the attachment point is located in the center of the quarter-wheel.

In one embodiment, the means for attaching resistance includes an attachment point positioned on the center of the quarter-wheel.

In one embodiment, the means for attaching resistance includes a first attachment point and a second attachment point, each of said first attachment point and said second attachment point are positioned on the quarter-wheel at an angle of between about 45 to 90 degrees apart, said angle measured from the first attachment point to the support means to the second attachment point.

In one embodiment, the means for attaching resistance includes at least one attachment point positioned on the quarter-wheel.

In one embodiment, the means for attaching resistance includes at (A) least one attachment point positioned on the quarter-wheel and (B) at least one handle.

In one embodiment, the means for attaching resistance includes at least one attachment point positioned on the quarter-wheel, and a means for maintaining contact between the resistance cable and the quarter-wheel.

In one embodiment, there exists at least one handle and a means for maintaining contact between the resistance cable and the quarter-wheel.

In one embodiment, the means for attaching resistance includes at least one attachment point positioned on the quarter-wheel, and there exists at least one handle and a means for maintaining contact between the resistance cable and the quarter-wheel.

In one embodiment, there exists a first handle and a second handle, wherein said first handle is positioned on the support means above the axis of rotation of the quarter-wheel and said second handle is positioned on the support means below the axis of rotation of the quarter-wheel; and the means for maintaining contact between the resistance cable and the quarter-wheel comprises a groove along the outer edge of the quarter-wheel; the means for attaching resistance includes a first attachment point and a second attachment point, each of said first attachment point and said second attachment point are positioned on the quarter-wheel at an angle of between about 65 to 90 degrees apart, said angle measured from the first attachment point to the support means to the second attachment point.

In one embodiment, the device comprises a first handle and a second handle, wherein both handles are positioned above the axis of rotation of the quarter-wheel; and a third handle and a fourth handle, whereas the third and fourth handle are positioned below the axis of rotation of the quarter-wheel.

In one embodiment, the device comprises a first handle and a second handle, wherein both handles are positioned below axis of rotation of the quarter-wheel; and the means for maintaining contact between the resistance cable and the quarter-wheel comprises a groove along the outer edge of the quarter-wheel; the means for attaching resistance includes an attachment point located at the center of the outer edge of the quarter-wheel.

In one embodiment, the quarter-wheel comprises a rigid piece of material with an ovular shape with a width of about 45 to 65 cm; the device comprises a first handle, a second handle, a third handle, and a fourth handle, wherein said first and second handles are positioned on the support means above the axis of rotation of the quarter-wheel and said third and fourth handle is positioned on the support means below the axis of rotation of the quarter-wheel; and the a means for maintaining contact between the resistance cable and the quarter-wheel comprises a groove along the outer edge of the quarter-wheel; and wherein the means for attaching resistance includes a first attachment point and a second attachment point, each of said first attachment point and said second attachment point are positioned on the quarter-wheel at an angle of between about 30 to 90 degrees apart, said angle measured from the first attachment point to the support means to the second attachment point.

EXAMPLES

Example 1

In one illustrative example of performing a trunk twist with one embodiment of the exercise device, an exerciser attaches resistance to the means for attaching resistance, 18. The exerciser hugs the support means, 10, to his or her chest, with one arm above and parallel to the quarter-wheel, 12, while the other arm is below and parallel to the quarter-wheel, 12. The means for attaching resistance, 18, is in the center of the quarter-wheel along the outer edge. The exerciser then performs a trunk twist turning away from the resistance. To perform a trunk twist in the opposite direction, the exerciser reorients the resistance and the exercise device to the opposite side.

Example 2

In one example, the apex of the quarter-wheel, 12, is approximately 25 to 40 cm from an exerciser's chest providing adequate distance from the body for resistance to the trunk muscles, just as a human arm does in a trunk twist without an exercise device. However, unlike the human arm, the exercise device is always stable. As a result, the exercise device allows an exerciser to perform a trunk twist while stabilizing the upper body, removing the scapular and glenohumeral involvement in a trunk twist and allowing for more efficient and greater force production through the trunk. In addition, when fully twisted, the amount of resistance is less than at neutral, which correlates to the human body's natural force production capabilities because when the muscles are in a shortened position, as they are when the trunk is fully twisted, muscles produce less force.

When the trunk twist is performed with the exercise device, the path of motion remains constant throughout the entire twist because the resistance travels along the groove 14 to guide the cable.

DESCRIPTION OF EXEMPLARY BENEFITS

From the description above, a number of advantages of some embodiments of the exercise device become evident:

1. The exercise device stabilizes the upper body, removing the scapular/glenohumeral involvement in a trunk twist, which allows for more efficient and greater force production through the trunk.

2. The exercise device is less expensive, more attractive, less bulky, and more portable than prior-art exercise devices. The exercise device is the only way to attach external load proximately to a user's trunk using a portable device.

3. The exercise device can use any source of external resistance, including a weight stack or an exercise band.

4. The support means is contoured so that it will be comfortable for the user.

5. The means for maintaining contact between the resistance cable and the quarter-wheel guides the user to use the appropriate path of motion.

6. The user can use the exercise device to perform a trunk twist with or without additional hip rotation.

7. The exercise device can be used to add resistance to other exercises, including crunches.

The exercise device and various embodiments can be used to perform a trunk twist, or other resistance exercises, more effectively and with a lower cost, smaller device. In addition, when it is used, the exercise device can guide the user in the appropriate path of motion without having to use a more cumbersome machine that locks the user into a certain path of motion.

Although the descriptions above contain many specificities, these should not be construed as limiting the scope of other potential embodiments but as merely providing illustrations of some of the several embodiments. For example, the support means comprises one or more pieces, e.g., a triangular piece, a "V" shaped piece, or a "Y" shaped piece similarly the means for attaching resistance can include various methods attached at any point along the quarter-wheel. Likewise, a half-wheel or quarter-wheel may be used. Thus, the scope of the embodiments should be determined by the appended claims and their legal equivalents, rather than by the examples given.

Moreover, it should be understood that various features and/or characteristics of different embodiments herein may be combined with one another. It is therefore to be understood that numerous modifications may be made to the illustrative embodiments and that other arrangements may be devised without departing from the scope of the invention.

Furthermore, other embodiments of the invention will be apparent to those skilled in the art from consideration of the specification and practice of the invention disclosed herein. It is intended that the specification and examples be considered as exemplary only, with a scope and spirit being indicated by the claims.

Finally, it is noted that, as used in this specification and the appended claims, the singular forms "a," "an," and "the," include plural referents unless expressly and unequivocally limited to one referent, and vice versa.

What is claimed is:

1. A resistance exercise device, comprising:

a quadrisected circle quarter-wheel;

a T-shaped support means, connected to the quadrisected circle quarter-wheel;

the T-shaped support means positioned at an axis of rotation of the quadrisected circle quarter-wheel; and a means for attaching resistance to the quadrisected circle quarter-wheel.

2. The resistance exercise device of claim 1, comprising a means for maintaining contact between a resistance cable and the quadrisected circle quarter-wheel.

3. The resistance exercise device of claim 2, the means for maintaining contact between the resistance cable and the quadrisected circle quarter-wheel comprising a guided path along an outer edge of the quadrisected circle quarter-wheel.

4. The resistance exercise device of claim 1, comprising at least one external handle protruding on the T-shaped support means.

5. The resistance exercise device of claim 4, comprising a first handle and a second handle, wherein said first handle is positioned on the T-shaped support means above the axis of rotation of the quadrisected circle quarter-wheel and said second handle is positioned on the T-shaped support means below the axis of rotation of the quadrisected circle quarter-wheel.

6. The resistance exercise device of claim 1, comprising at least one external handle protruding from the quadrisected circle quarter-wheel.

7. The resistance exercise device of claim 1, wherein the means for attaching resistance includes at least one attachment point positioned on the quadrisected circle quarter-wheel.

8. The resistance exercise device of claim 7, comprising a first attachment point and a second attachment point, each of said first attachment point and said second attachment point are positioned on the quadrisected circle quarter-wheel at an angle of between about 130 to 180 degrees apart, said angle measured from the first attachment point to the T-shaped support means to the second attachment point.

9. The resistance exercise device of claim 1, wherein the quadrisected circle quarter-wheel has a width of about 15 to 85 cm, measured from the axis of rotation to an outer edge of the quadrisected circle quarter-wheel.

10. The resistance exercise device of claim 1, wherein the quadrisected circle quarter-wheel has a width of about 45 to 65 cm, measured from the axis of rotation to an outer edge of the quadrisected circle quarter-wheel.

11. The resistance exercise device of claim 1, wherein the quadrisected circle quarter-wheel comprises a rigid piece of material.

12. The resistance exercise device of claim 1, wherein the means for attaching resistance includes at least one attachment point positioned on the quadrisected circle quarter-wheel, and including at least one handle.

13. The resistance exercise device of claim 1, wherein the means for attaching resistance includes at least one attachment point positioned on the quadrisected circle quarter-wheel, and including a means for maintaining contact between a resistance cable and the quadrisected circle quarter-wheel.

14. The resistance exercise device of claim 1, comprising at least one handle and including a means for maintaining contact between a resistance cable and the quadrisected circle quarter-wheel.

15. The resistance exercise device of claim 1, wherein the means for attaching resistance includes at least one attachment point positioned on the quadrisected circle quarter-wheel, and including at least one handle, and including a means for maintaining contact between a resistance cable and the quadrisected circle quarter-wheel.

16. The resistance exercise device of claim 1, including a first handle, a second handle, wherein said first handle and second handle are positioned on the T-shaped support means above the axis of rotation of the quadrisected circle quarter-wheel; and including a means for maintaining contact between a resistance cable and the quadrisected circle quarter-wheel comprising a groove along an outer edge of the quadrisected circle quarter-wheel; wherein the means for attaching resistance includes an attachment point at the apex of the quadrisected circle quarter-wheel.

17. The resistance exercise device of claim 1, wherein the quadrisected circle quarter-wheel comprises a rigid piece of material in an ovular shape with a width of about 45 to 65 cm, measured from the axis of rotation to an outer edge of the quadrisected circle quarter-wheel; including a first handle, a second handle, a third handle, and a fourth handle, wherein said first handle and second handles are positioned on the T-shaped support means above the axis of rotation of the quadrisected circle quarter-wheel and said third and fourth handles are positioned on the T-shaped support means below the axis of rotation of the quadrisected circle quarter-wheel; and including a means for maintaining contact between a resistance cable and the quadrisected circle quarter-wheel comprising a groove along the outer edge of the quadrisected circle quarter-wheel; and wherein the means for attaching resistance includes an attachment point at the apex of the quadrisected circle quarter-wheel.

* * * * *